US006890381B2

(12) United States Patent
Ozawa et al.

(10) Patent No.: US 6,890,381 B2
(45) Date of Patent: May 10, 2005

(54) HYDRAULIC-COMPOSITION BONDED MAGNET

(75) Inventors: Satoshi Ozawa, Funabashi (JP); Eishi Fukuda, Anan (JP); Shuuji Matsumura, Higashimatsuyama (JP)

(73) Assignees: Sumitomo Osaka Cemet Co., Ltd. (JP); Nichia Corporation (JP)

( * ) Notice: Subject to any disclaimer, the term of this patent is extended or adjusted under 35 U.S.C. 154(b) by 0 days.

(21) Appl. No.: 10/258,928

(22) PCT Filed: Apr. 27, 2001

(86) PCT No.: PCT/JP01/03691

§ 371 (c)(1),
(2), (4) Date: Mar. 4, 2003

(87) PCT Pub. No.: WO01/84563

PCT Pub. Date: Nov. 8, 2001

(65) Prior Publication Data

US 2003/0155548 A1 Aug. 21, 2003

(51) Int. Cl.[7] ..... H01F 1/04

(52) U.S. Cl. ..... 106/640; 106/644; 252/62.51 R; 252/62.55

(58) Field of Search ..... 106/640, 644; 252/62.51 R, 62.55

(56) References Cited

FOREIGN PATENT DOCUMENTS

| | | | |
|---|---|---|---|
| JP | 64-77104 | | 3/1989 |
| JP | 1-215902 | | 8/1989 |
| JP | 01-237410 | * | 9/1989 |
| JP | 3-160705 | | 7/1991 |
| JP | 3-212907 | | 9/1991 |
| JP | 5-182810 | * | 7/1993 |
| JP | 6-244553 | | 8/1994 |
| JP | 7-267711 | | 10/1995 |
| JP | 7-315902 | | 12/1995 |
| JP | 2000-11355 | | 2/2000 |
| WO | WO 92/8678 | * | 5/1992 |

* cited by examiner

*Primary Examiner*—C. Melissa Koslow
(74) *Attorney, Agent, or Firm*—Wood, Phillips, Katz, Clark & Mortimer

(57) ABSTRACT

An object of the present invention is to provide a hydraulic-composition bonded magnet having moldability, heat resistance, corrosion resistance and high strength.

A hydraulic-composition bonded magnet according to the present invention is characterized by that a magnetic powder is held in a hydraulic composition produced by cure of a hydraulic powder. Preferably, in the hydraulic-composition bonded magnet, the hydraulic composition is cured together with a non-hydraulic powder. More preferably, a processing modifier is added to the hydraulic-composition bonded magnet.

3 Claims, No Drawings

HYDRAULIC-COMPOSITION BONDED MAGNET

TECHNICAL FIELD

The present invention relates to a hydraulic-composition bonded magnet containing a magnetic powder.

BACKGROUND ART

By the hydraulic-composition bonded magnet is meant a material in which particles of a magnetic powder are uniformly held in a matured/cured hydraulic composition as a bonding agent.

There was proposed an R—Fe—B based permanent magnet of high magnetic properties, which utilizes Nd and Pr, light rare earth elements abundant as resources, and B and Fe as main components and which has an excellent corrosion resistant film (Japanese Unexamined Patent Publication No. Hei-10-154611). This R—Fe—B based permanent magnet is made by putting a film layer having a Si—Na—O based glassy material of a specified film thickness and a fine crystalline material on the surface of an R—Fe—B based permanent magnet body having a tetragonal system as the main phase. In this conventional art, a rare earth-based bonded magnet is produced by using water glass (sodium silicate) as a binder.

However, this rare earth-based bonded magnet does not exhibit sufficiently improved moldability, heat resistance, corrosion resistance and strength, and thus was subjected to the following improvements in terms of moldability, heat resistance, corrosion resistance and strength. These were attributed to a basic problem inherent to conventional rare earth magnets. That is, they are likely to rust because of being made from active metal materials, which leads to the deterioration of magnetic properties. In order to solve this rust problem and improve the properties, a surface of a hard magnetic powder has been subjected to conversion treatment such as phosphate treatment or chromate treatment to form an oxidation-resistant conversion film (Japanese Unexamined Patent Publication No. Hei-1-14902), subjected to vapor deposition of Zn or Al, or electroless Ni plating (Japanese Unexamined Patent Publication No. Sho-64-15301), or an inhibitor such as sodium sulfite has been added to a resin binder (Japanese Unexamined Patent Publication No. Hei-1-147806). However, such surface treatment primarily focuses attention on the improvement of corrosion resistance, and does not pay attention to properties (adhesion properties, strength) resulting from the combination with a resin binder, the largest characteristic of a bonded magnet, and therefore problems with moldability, strength and magnetic properties still remain.

In addition, further with these problems, a method of making a silicon dioxide protective coat (hereinafter, referred to as "$SiO_2$ coat") on the particle surface has been investigated. However, it is not easy to form a homogeneous, dense, strong $SiO_2$ coat on the surface of a magnetic powder having complicated shape and surface structure and having a particle size of the order of $\mu$m. Japanese Unexamined Patent Publication Nos. Sho-62-152107 and Hei-8-111306 also propose a method of forming a $SiO_2$ coat or a silicate protective film on the particle surface. However, it is technically impossible to coat the particle surface with a 100% complete film.

Furthermore, the method disclosed in Japanese Unexamined Patent Publication No. Sho-62-152107 utilizes a reaction active silyl isocyanate, but this method is difficult to grow uniform nuclei and is likely to produce an uneven film. It is impossible to make a stiff coat by uneven physical adsorption on a magnetic powder only using a silicate. On the other hand, Japanese Unexamined Patent Publication No. Hei-8-111306 discloses a method of forming a $SiO_2$ coat on a magnetic powder surface by using ethyl silicate by means of a sol-gel process, or a plasma chemical vapor deposition. However, the film thickness is as thick as 0.1 to 2.0 $\mu$m as is produced by the conventional sol-gel reaction, and so the film is not homogeneous, dense and strong.

Additionally, for bonded magnets using a Fe—Nd—B based alloy powder, a variety of methods have been studied that involve producing a bonded magnet by coating a magnetic powder with a resin as well as performing oxidation-resistant and corrosion resistant treatment by the oxidation film process. For example, Japanese Unexamined Patent Publication No. Sho-51-38641 discloses a method, which involves using a thermosetting resin (epoxy resin), and Japanese Unexamined Patent Publication No. Sho-50-104254 discloses a process, which involves using a thermoplastic resin (nylon). However, for the method which utilizes an epoxy resin, the mold flowability during compression molding is poor, heat treatment hardening (hereinafter referred to cure) after molding is required, the contraction coefficient is large (2 to 5%), and the molded body produced is not practically usable under a high temperature (150° C. or higher) environment, and further the molded body must be subjected to high melting point resin coating or surface treatment such as plating in order to improve the corrosion resistance, yet it is not sufficient for preventing the generation of rust. Moreover, an injection molding magnet using a thermoplastic resin such as a nylon resin is proposed as well, but the magnet causes a problem relating to corrosion resistance that it is rusted by water absorption even if the resin is uniformly coated on the powder surface, inasmuch as the surface treatment of the powder is not performed, or even though it is done, the method is not optimal.

In addition, for a heat resistant, consideration is conventionally made to the heat resistance only when the magnets are used. For example, with general flow solder or reflow solder, treatment is performed at a high temperature of 230 to 270° C. Accordingly, when molding is carried out using a nylon resin or epoxy resin, the resin cannot hold its shape at such a high temperature resulting in deformation, which in turn causes the problem of adversely affecting the function as a magnet material.

In order to solve the above problems, Japanese Unexamined Patent Publication Nos. Hei-2-22802 and Hei-2-281712 disclose a method that involves coating a rare earth magnetic powder with a super-engineering resin such as a polyether ketone or polysulfide ketone and subsequently compression molding, injection molding or performing extrusion. However, the method which utilizes a super-engineering resin cannot uniformly coat a powder either because of poor wettability between the powder surface and the resin, and also has difficulty in molding. As a result, this method has not been put into a practical use. Additionally, of super-engineering resins, even a material using a polyphenylene sulfide resin (PPS) of relatively easily being compounded generates sulfur dioxide gas during kneading or during molding by heating. Also, compounding with a ferromagnetic powder contained in an amount exceeding about 70% produces large adverse effects on magnetic properties and physical properties of the magnetic powder due to the necessity of a very high temperature and high shear, leading to difficulty of highly filling.

As discussed above, it is impossible to completely suppress the generation of rust by the conventional method that involves applying oxidation resistant treatment and corrosion resistant treatment on the surface of a rare earth element-based hard magnetic powder, or hardening with a resin to produce a bonded magnet. Accordingly, it is impossible to produce a bonded magnet material that has high magnetic properties as well as heat resistance and corrosion resistance by the conventional method.

DISCLOSURE OF THE INVENTION

Thus, the present inventors performed an intensive study for solving the above problems, found out that use of a hydraulic composition as a binder as well as addition of a processing modifier, or the like, as required, enables any molding methods, which involves applying pressure or compression force, injection molding, or extrusion molding, and that a hydraulic-composition bonded magnet produced by subsequent maturing cure exhibits considerably excellent corrosion resistance, heat resistance and high strength, and thereby have achieved the present invention.

That is, a hydraulic-composition bonded magnet of the present invention (hereinafter also simply referred to as a "bonded magnet") is characterized in that a magnetic powder is held in a hydraulic composition formed by the cure of a hydraulic powder, and is preferably characterized by the magnetic powder being a rare earth element-based hard magnetic powder. In addition, the aforementioned hydraulic composition is preferably cured along with a non-hydraulic powder. Moreover, the bonded magnet preferably comprises 2 to 90 parts by weight of a hydraulic composition comprising 30 to 100% by weight of a hydraulic powder and 0 to 70% by weight of a non-hydraulic powder, 10 to 98 parts by weight of a magnetic powder, 0 to 35 parts by weight of a processing modifier, and 0 to 10 parts by weight of water.

The reasons why a bonded magnet of the present invention exhibits extremely excellent corrosion resistance and heat resistance and high strength are as follows.

That is to say, a binding agent for a hydraulic-composition molded body comprises two components of a hydrated product from a hydraulic powder and a polymer from a processing modifier, and thus being a co-matrix. Also, the hydrated product grows to a crystalline compound through the conduct of high-pressure vapor maturing, and thus the molded body comes to have a dense structure of a high strength. In addition, the solution becomes alkaline during the hydration of a hydraulic powder (in this case, cement is used as the hydraulic powder, and thus the hydration generates $Ca(OH)_2$ to produce a strong alkaline surrounding) to form an oxidation film on the magnetic material surface resulting in a passivated material. This maturing process is performed under a high-temperature vapor environment, so that the formation of an oxidized layer into the inside of the metal and the generation of a multi-layered oxidized film proceed, thereby forming a strong passivated film exhibiting corrosion resistance.

The hydration reactions of a cement compound are shown below for reference.

$$C_3S+6H_2O \rightarrow C_3S_2H_3+3Ca(OH)_2$$

$$2C_2S+4H_2O \rightarrow C_3S_2H_3+Ca(OH)_2$$

$$2C_3A+27H_2O \rightarrow C_4AH_{19}+C_2AH_8$$

$$C_4AH_{19}+C_2AH_8 \rightarrow 2(C_3AH_6)+15H_2O$$

$$C_3A+3CaSO_4+32H_2O \rightarrow C_2A.3CaSO_4.32H_2O$$

$$2C_3A+C_3A.3CaSO_4.32H_2O+4H_2O-3(C_3A.CaSO_4.12H_2O)$$

$$C_4AF+(8+n)H_2O \rightarrow C_2AH_8+C_2FHn$$

$$C_4AF+3CaSO_4+32H_2O \rightarrow C_3(AF).3CaSO_4.32H_2O+Ca(OH)_2$$

If a magnetic powder includes at least one transition metal selected from the group consisting of Fe, Co and Ni, a layered structure (passivated layer) of an inner oxidized film comprising at least one selected from the group consisting of the transition metals Fe, Co and Ni and an outer oxidized film comprising at least one transition metal selected from the group consisting of the transition metals Fe, Co and Ni is thought to be formed at the interface between the magnetic powder particle and a hydraulic composition around the particle, when seen from the magnetic powder particle side. For example, when Fe is taken as an example, a layered structure is formed at the interface between a magnetic powder particle and mature cured hydraulic composition in the following order: the magnetic powder particle, an inner oxidized film (FeO formed on the particle surface), an outer oxidized film (1) ($Fe_3O_4$), an outer oxidized film (2) ($Fe_2O_3$), and mature cured hydraulic composition.

Formation of such a strong passivated layer is estimated to effectively prevent the rust of a magnetic powder particle and hence a bonded magnet. These oxidized films are not formed under a conventional oxidizing environment, but are formed under a strong alkaline environment produced by the hydration reaction of a hydraulic composition, and thus are considered to have a strong passivated layer that has never been created before. In addition, the thicknesses of the outer oxidized layers (1) and (2) are thought to be a couple of angstroms to tens of micrometers, although varied dependent on the power particle size.

BEST MODE FOR CARRYING OUT THE INVENTION

The present invention will be described in detail below.

(1) Magnetic Powders

Magnetic powders include powders of, for example, rare earth element-based, ferrite based, alnico based, Mn—Al based, Fe—Cr—Co based, Pt—Fe based, and Pt—Co based magnets. The description will be herein made by taking for example a case of using a rare earth element-based hard magnetic powder.

Here, rare earth element-based hard magnetic powders refer to alloys comprising an yttrium based or lanthanoid based rare earth metal R and a transition metal TM and to alloy powders represented by the general formula RTMz (z=4.6 to 8.8), and also include nano-composite magnet materials comprising Sm—Co based, Nd—Fe—B based, Sm—Fe—N based or Sm—Fe—Ti based alloy and a hard magnetic material thereof or a soft magnetic material thereof. The "hard" of a rare earth based hard magnetic powder refers to having a magnetic coercive force, enabling itself to be a magnetic material.

Examples of nano-composite material include the following compositions (hard magnetic material phase/soft magnetic phase).

$Nd_4Fe_{80}B_{20}/Fe_3B$—Fe
$Nd_{4.5}Fe_{75}Co_3Ga_1B_{18.5}/Fe_3B$—Fe
$Nd_{3.8}Dy_1Fe_{73}Co_3GaB_{18.8}/Fe_3B$—Fe
$Nd_{9.7}Fe_{84}Mo_{7.8}/\alpha$-Fe
$Nd_{5.5}Fe_{66}Cr_5Co_5B_{18.5}/Fe_3B$-$\alpha$-Fe
$Nd_{7.2}Fe_{85}Mo_{7.8}Nx/Fe_{85}Mo_{7.8}Nx$
$Nd_{3.5}Fe_{91}Nb_2B_{3.5}/Fe$
$Nd_9Fe_{85}B_6/\alpha$-Fe
$Nd_8Fe_{86}B_6/\alpha$-Fe
$Nd_{7.5}Fe_{87}B_{5.5}/\alpha$-Fe
$Nd_7Fe_{89}B_4$/Amorphous-$\alpha$-Fe $Sm_7Fe_{93}Nx/\alpha$-Fe
$Sm_8Zr_3Fe_{85}Co_4$-Nx/$\alpha$-Fe
$Sm_{11.67}Co_{58.38}Fe_{30}/\alpha$-Fe
$SmCo_{10}$/Co In the present invention, these can be singly used or also in the form of a composite of two species or more. In addition, for the adjustment of magnetic properties, as required, oxide based magnetic powders such as Ba or Sr based ferrite, and La—Co based ferrite can be hybridized with the aforementioned rare earth element-based magnetic powders as well.

(2) Hydraulic Compositions

A hydraulic composition used in the present invention refers to a material containing a hydraulic powder, a non-hydraulic powder and a processing modifier, and as necessary includes other additives. The hydraulic composition can be produced by admixing a rare earth element-based hard magnetic powder with a hydraulic composition to yield a mixed powder thereof, molding the mixed powder, and then mature curing. Upon preparation, as required, water or solvent is added.

(2-1) Hydraulic Powders

Hydraulic powders used in the present invention represent powders cured by water, and examples of which include a calcium silicate compound powder, a calcium aluminate compound powder, a calcium fluoroaluminate compound powder, a calcium sulfoaluminate compound powder, a calcium aluminoferrite compound powder, a calcium phosphate compound powder, a semihydrate or anhydrous plaster powder, a self-curing limestone powder, and a mixture powder of two or more of these powders. A typical example of these powders can include, for example, a powder like Portland cement.

For the size distribution of hydraulic powders, the Blaine_specific surface area is preferably 2500 $cm^2/g$ or more, when considering the attainment of hydraulicity performance that affects the strength of a molded body. In addition, the amount of the mixed hydraulic powder is preferably 30 to 90% by weight and more preferably 40 to 60% by weight based on the total amount (100% by weight) of the hydraulic powder and a non-hydraulic powder. When the amount of mixed hydraulic powder is less than 30% by weight, the strength and the filling ratio of a molded body are lowered. When the amount exceeds 90% by weight, the filling ratio of a molded body is reduced. Neither of them are preferable.

(2-2) Non-Hydraulic Powders

Non-hydraulic powders refer to powders that do not cure even when it singly comes into contact with water, and also include a powder in which components thereof dissolve and react with other already dissolved components in an alkaline or acidic state or under a high-pressure vapor atmosphere to form products. Typical examples of nonhydralic powders include a calcium hydroxide powder, a sodium hydroxide powder, a dihydrated plaster powder, a calcium carbonate powder, a slag powder, a fly ash powder, a silica powder, a clay powder, a silica fumed powder, talc, mica, carbon black, a glass powder, rice husk ash, pozzolan, and silicate white clay. The mean particle size of these non-hydraulic powders is smaller by one or more orders of magnitude than the mean particle size of hydraulic powders, preferably smaller by two or more orders of magnitude. The amount of the mixed non-hydraulic powder is preferably 10 to 70% by weight with respect to the total amount of the non-hydraulic powder and a hydraulic powder, more preferably 45 to 55% by weight.

Mixing a non-hydraulic powder in the amount of less than 10% by weight decreases the filling ratio. When the amount exceeds 70% by weight, the strength and the filling ratio are decreased. Neither of them are preferable inasmuch as various physical properties after molding and curing, since, for example, cracks may occur and dimension stability may be adversely affected. Mixing a non-hydraulic powder can enhance the fillability of a molded body during molding and thus can reduce porosity of the molded body produced.

(2-3) Processing Modifiers

A processing modifier refers to a material having properties that contribute to the improvement of moldability, releasability, cutting and grinding properties and grinding precision of a bonded magnetic molded body molded from a hydraulic composition, but does not refer to a binder resin conventionally referred to in a bonded magnet. In other words, the processing modifier serves as a molding aid during molding to improve moldability and also increases the Green strength of a molded body produced by improving the brittleness of a cement based cured body, and further contributes to the advancement of workability. In addition, for a molded body produced from a hydraulic composition of a material being generally brittle, which is likely to be broken or chipped due to the cracking type mechanism during cutting, the processing modifier serves to prevent the occurrence of such cracks as well.

The amount of a processing modifier to be blended is preferably 2 to 35% by weight and more preferably 3 to 10% by weight in a dried state based on 100 parts by weight of a mixture powder comprising a hard magnetic powder, a hydraulic powder and a non-hydraulic powder.

Blending the processing modifier in the amount of less than 2% by weight results in difficulty in preventing the occurrence of breaks and chips due to the cracking type mechanism during cutting. When the amount is 35% by weight or more, the dimension stability of a molded body is reduced.

Examples of processing modifiers include a powder or emulsion made of at least one selected from the group comprising thermoplastic resins such as polyethylene, polypropylene, vinyl polypropionate, polybutene, poly-4-methylpentene, ionomer, polyvinyl chloride, vinylidene chloride vinyl chloride, polyvinylidene chloride, ABS resins, polystyrene, acrylonitrile/styrene copolymer resins, methacryl resins, polyvinyl alcohol, cellulose acetate, cellulose butyrate, cellulose acetate butyrate, ethyl cellulose, methyl cellulose, benzyl cellulose, thermoplastic elastomers, polyamide resins, polyacetal, polycarbonate, modified polyphenylene ethers, thermoplastic polyesters, polytetrafluoroethylenes, fluorine resins, polyphenylenesulfides, polysulfones, polyether sulfones, polyether ketones, liquid crystalline polyesters, polyamideimides, polyimides, polyaryl ether nitrile, polybenzoimidazole, photosensitive polymers, noncrystalline polyacrylates, copolymerized polyester resins and polyether imides, thermosetting resins such as unsaturated polyester resins, phenol resins, melamine-urea resins, polyurethane resins, silicone resins, polyimide resins, photosetting resins, vinylester resins, furan resins, diarylphthalate resins and alkyd resins, and resins and rubbers having modified terminal groups thereof, rubber latex: natural latex, chloroprene rubber, styrenebutadiene rubber, methylbutadiene methacrylate rubber, vinyl acetate resin, vinyl acetate acryl copolymer resins, vinyl acetate veoba copolymer resins, vinyl acetate malate copolymer resins, vinyl acetate ethylene copolymer resins, vinylethylene acetate vinyl chloride copolymer resin, acryl copolymer resins, acryl styrene copolymer resin, acryl silicone copolymer resins, vinyl acetate veoba three-dimensional copolymer resins, epoxy resins, and other water-absorbing resins.

(3) Other Additives (3-1) Lubricants

Examples of lubricants include single materials and mixtures of paraffin, stearic acid, stearyl alcohol, ethylenebisstearoamide, glycerin triesters, glycerin monoesters, calcium stearate, magnesium stearate, lead stearate, and other complex-ester-based and aliphatic lubricants.

(3-2) Coupling Agents

Examples of coupling agents include single compounds and mixtures of silane-based coupling agents bearing silicon such as γ-aminopropyltrietoxysilane, N-β-aminoethyl-γ-aminopropyltrimetoxysilane, γ-mercaptopropyltrimethoxysilane, γ-ureidopropyltrimethoxysilane and perfluoroalkyltrimethoxysilane, titanate-based coupling agents, and aluminate-based coupling agents.

(4) Methods of Preparing and Molding a Mixture Comprising Hydraulic Compositions (4-1) Preparation of a Mixture Comprising Hydraulic Compositions Preparation of a mixture for molding by use of a hydraulic composition of the present invention involves mixing 20 parts by weight or less of water, preferably 15 parts by weight or less, with 100 parts by weight of a mixture comprising a rare earth element-based hard magnetic powder, a hydraulic compound and, as required, other additives, to thereby obtain a mixture comprising a hydraulic composition.

The apparatus used for mixing is not necessarily limited to a particular type, and therefore for example, a universal mixer, ribbon blender, tumbler, Nauter mixer, Henschel mixer, super mixer, kneader, roll, kneaderuder, spray dryer, vibration flow dryer, or immediate vacuum drying apparatus can be used.

Furthermore, it is also possible to granulate the mixture into an appropriate size of particle in order to achieve improved handling of the mixture during molding and hence improved moldability.

(4-2) Molding Method

The aforementioned mixture thus produced can be subjected to any molding such as pressure, compression and injection molding and extrusion. According to pressure compression molding, the mixture can be pressurized by means of, for example, hydrostatic pressure press, multi-axis press, or one-axis press, using a mold of 10ϕ×7 t, etc. For pressure conditions, the higher the press pressure, the more preferable it is in order to bring the structure close to a theoretical density to be calculated; however, its lower limit condition largely varies depending on molding readiness of a mixture, the ratio of water content, difference in size precision to be required, etc.

(4-3) Maturing and Curing

Maturing is preferable inasmuch as it requires several hours to several days for a product to exhibit a sufficient strength after molding and being taken out of a mold. The maturing method involves allowing a product to stand at room temperature until it is matured, or maturing in water or in vapor, preferably maturing in an autoclave. In addition, when the amount of water to be required for forming a cured body is lacking or insufficient, vapor maturing is preferable.

According to the present invention, a rare earth element-based magnetic powder is neither oxidation deteriorated nor varied in magnetic properties even though vapor maturing is performed, and therefore a desired hydraulic-composition bonded magnet can be produced.

(5) Magnetic Coercive Force

A hydraulic-composition bonded magnet of the present invention is prepared so that the magnetic coercive force thereof (iHc) is 40% or more and preferably 60% or more of the magnetic coercive force of a rare earth element-based hard magnetic powder itself, which serves a raw material.

More specifically, use of a magnetic powder raw material of a high magnetic coercive force as well as preparation of a hydraulic-composition bonded magnet according to the formulation as mentioned above allow the inside of the hydraulic composition to be alkaline and hence a passivated layer to be formed on the surface layer of the magnetic powder, thereby enabling a hydraulic-composition bonded magnet of a high magnetic coercive force to be produced.

In addition, for heat resistibility, the magnetic coercive force of the hydraulic-composition bonded magnet is preferably 7 kOe or more, which allows a hydraulic-composition bonded magnet less likely to decrease in magnetic properties (namely, a hydraulic-composition bonded magnet having 2 small initial demagnetizing factor) to be produced even when the magnet is treated at a high temperature of about 250° C.

(6) Porosity

The porosity in the present invention is evaluated by means of the equation below, from a theoretical density produced from physical properties of materials constituting a hydraulic-composition bonded magnet and an actual density produced by molding.

$$\text{Porosity (\%)}=(1-\text{actual density/theoretical density})\times 100$$

According to a hydraulic-composition bonded magnet of the present invention, the porosity thereof is preferably 20% or less, which can enhance the bond strength of a molded body and also prevent cracks caused by the thermal expansion of gas in the pores.

As a result, limiting the porosity to be 20% or less enables a hydraulic-composition bonded magnet having a heat resistance temperature of about 250° C. to be produced.

In order to limit the porosity to 20% or less, the filling degree of a powder is preferably improved by adjusting the particle sizes of the aforementioned hydraulic and non-hydraulic powders and magnetic powder. More specifically, since the mean particle size of cement is 20 μm or less, the particle size is limited to less than 20 μm. In addition, the molding pressure is 1.0 t/cm$^2$ and more preferably 2.0 t/cm$^2$ or more. Furthermore, a polymer is preferably added in order to uniformly distribute molding pressure and prevent spring back.

(7) Improvement of Heat Resistance by Means of Colloidal Silica

A hydraulic-composition bonded magnet of the present invention is preferably prepared by adding 1 to 10 parts by weight of colloidal silica to 100 parts by weight of a hydraulic composition and subsequently maturing the resultant at 120° C. or higher. Alternatively, it is preferable to impregnate colloidal silica into a hydraulic-composition bonded magnet and then the resultant is matured at 100° C. or higher to obtain a hydraulic-composition bonded magnet.

Colloidal silica is a material in which silica with an extremely fine particle diameter of 0.01 to 0.02 μm is dispersed in a stabilized manner. Addition of such colloidal silica allows it to penetrate into extremely small pore portions in the aforementioned bonded magnet, thereby densely filling pores with colloidal silica. Then, after drying, the fine particles of the colloidal silica move closer to each other and hence are bonded with each other. Thus, a strong adhesive strength can be produced.

In addition, the curing reaction of the colloidal silica is to form a siloxane bond (≡Si—O—Si≡), and therefore the bonding energy is very large leading to excellent heat resistance.

Examples of the present invention will be discussed hereinafter.

The examples below are only for specific explanation for better understanding of the spirit of the present invention and therefore any limitation of the invention by these examples is not intended.

EXAMPLE 1

(A) Preparation of a Hydraulic-composition Bonded Magnet

To the raw materials indicated below was added water and mixed, and then the resulting material was press molded at an application pressure of 1.2 ton/cm$^2$ without a magnetic field using a press machine (product of Fujidempa Kogyo Co., Ltd., hot press machine High Multi 5000, mold 10ϕ). Thereafter, the material was matured in an autoclave (conditions of 180° C. and an atmospheric pressure of 9.9) to obtain a molded body of a 10ϕ×7 t cylinder shape best suited to measuring magnetic properties.

(1) Rare earth element-based hard magnetic powder: Nd—Fe—B based alloy powder subjected to oxidation resistance treatment (MQP-B available from MQI Corp.) 87 parts by weight (2) Hydraulic powder: Portland cement 6 parts by weight (3) Non-hydraulic powder: silica fumed 7 parts by weight (4) Processing modifier: acrylic resin with the amount indicated in Table 1

(B) Measurements of Magnetic Properties and Density and Evaluation of Heat Resistance and Corrosion Resistance (B-1) Magnetic Properties The magnetic properties of the Nd—Fe—B based hydraulic-composition bonded magnet were measured using a BH curve tracer (product of Riken Densi Co., Ltd., BHU-6020, measured after 5T pulse magnetization, magnetizer: product of Nihon Denjisokki Co., Ltd., SCB-2510 MD). On the other hand, the properties of raw material powders (iHc) were measured by MODEL VSM VT-800 (product of Riken Densi Co., Ltd.), which measurement was made after 5T pulse magnetization. The results are shown in Table 2.

(B-2) Density

The density of the molded body was measured using AccuPyc 1330 (product of MICROMETRICS) at room temperature. The result is given in Table 2.

(B-3) Evaluation of Heat Resistance

The heat resistance of the molded body was evaluated according to JIS-K 7207 "Temperature test A method for distortion of hard plastics by loading". The result is given in Table 2. The molded body exhibits excellent heat resistance with a HDT (18.6 kg/cm$^2$) of above 280° C., which further exceeds that of a super engineering plastic.

(B-4) Corrosion Resistance

The corrosion resistance of the molded body was subjected to 5% salt spray testing of JIS-Z 2371. As a result, the occurrence of rust was not found at the time point when 180 days passed.

EXAMPLE 2

An operation similar to the case of Example 1 was conducted with the exception that an Sm—Fe—N based magnetic powder (product of Nichia Corporation, RTN, Z12 mean particle diameter 2.3 μm) was used in place of an Nd—Fe—B based alloy powder and that molding was conducted in a magnetic field by means of an orientation magnetic field generating apparatus (product of Toei Kogyo Co., Ltd., generated magnetic field 12 KOe, 50 mm gap, pulse magnetic field) during press molding. As a result, there was produced an excellent Sm—Fe—N based hydraulic-composition bonded magnet as indicated in Table 2.

EXAMPLE 3

An operation similar to the case of Example 2 was conducted except that an Sm—Co powder (product of Shin-Etsu Chemical Co., Ltd., 2-17 system, mean particle diameter 7 μm) was used for a ferromagnetic powder, and molding was carried out through the application of a magnetic field of 12 kOe using an orientation magnetic field generating apparatus during press molding. As a result, the product showed good magnetic properties and corrosion resistance as indicated in Table 2.

EXAMPLE 4

An operation similar to the case of Example 2 was conducted with the exception that an Nd—Fe—B based anisotropic powder (product of MQI Corp., MQA-T) was used instead of an Nd—Fe—B based isotropic powder. As a result, there was produced an excellent Nd—Fe—B based anisotropic, hydraulic-composition bonded magnet as shown in Table 2.

EXAMPLE 5

To the raw materials indicated below was added water and mixed, and then the resulting material was extruded at a pressure of 150 kg/cm$^2$ without a magnetic field using an extruder (product of Ikegai Tekko Co., Ltd., PCM two-axis extruder mold 10ϕ). Thereafter, the material was cut into a length of 7 mm and matured in an autoclave (conditions of 180° C. and an atmospheric pressure of 9.9) as in Example 1 to obtain a molded body of a 10ϕ×7 t cylinder shape as a hydraulic-composition bonded magnet.

(1) Rare earth element-based hard magnetic powder: Nd—Fe—B based alloy powder (available from MQI Corp., MQP-B) 87 parts by weight (2) Hydraulic powder: Portland cement 6 parts by weight (3) Non-hydraulic powder: fly ash 5 parts by weight silica powder 2 parts by weight (4) Processing modifier: acrylic resin with the amount indicated in Table 1 methyl cellulose 3 parts by weight The evaluation results as were produced in a manner similar to Example 1 are given in Table 2.

The reason why the kind and amount of processing modifier of Example 1 were set to be the same as those of the modifier in Example 4 is that the difference between the two magnetic bodies is compared in isotropy and anisotropy. Use of different kinds of processing agents in Examples 2 and 3 has shown that a hydraulic-composition bonded magnet of the present invention can be prepared by means of a variety of materials even using an acrylic resin.

Use of the formulation of Example 5 in extrusion shows that any molding method can be selected, as a result of utilizing a magnetic body and a processing modifier similar to those in Examples 1 and 4.

TABLE 1

| Example | Kind of processing modifiers | Parts by weight |
|---|---|---|
| 1 | Vinyl acetate acryl copolymer resin | 5.0 |
| 2 | Acryl styrene copolymer resin | 10.0 |
| 3 | Acryl silicone copolymer resin | 10.0 |
| 4 | Vinyl acetate acryl copolymer resin | 5.0 |
| 5 | Vinyl acetate acryl copolymer resin | 2.5 |

EXAMPLE 6

A hydraulic-composition bonded magnet was produced in accordance with Example 1 with the exception that an Nd—Fe—B based alloy powder without oxidation resistance treatment was used as a rare earth element-based hard magnetic powder. The hydraulic-composition bonded magnet thus produced was measured for the irreversible demagnetizing factor as described below by means of an irreversible demagnetization measuring method (150° C.).

The irreversible demagnetizing factor refers to the ratio between the flux value measured after a 10ϕ×7 t cylindrical molded body is magnetized via a 5T pulse as in Example 1 using a magnetizer (product of Nihon Denjisokki Co., Ltd., SCB-2510 MD) and a flux value measured when the body is allowed to stand at 150° C. in an over after the magnetization and then the temperature is returned to room temperature, and the factor was determined by means of a digital flux comparator (product of Nihon Denjisokki Co., Ltd., MODEL BHU-6020).

As a result, the irreversible demagnetizing factor was minus 2.1%, which means that the magnetic heat resistance is twice or more that of a conventional molded body, and the physical heat resistance HDT (18.6 kg/cm$^2$) was more than 280° C. This Example shows that preparation of a hydraulic-composition bonded magnet using a hydraulic composition as a binder enables the improvement of both the magnetic heat resistance and the physical heat resistance.

COMPARATIVE EXAMPLE 1

A bonded magnet was produced from the rare earth element-based hard magnetic powder and sodium silicate/water glass. In other words, an Nd—Fe—B based alloy powder similar to the powder of Example 1 was admixed with sodium silicate-based water glass in the ratio below, and the resulting mixture was press molded as in Example 1 and then heated at 180° C. for 100 minutes in an inert gas to yield a magnetic molded body. As a result, with the corrosion resistance, rust was generated already in 24 h by salt spray testing and the magnetic properties were deteriorated.

(1) Rare earth element-based hard magnetic powder: Nd—Fe—B based alloy powder (product of MQI Corp. MQP-B) 87 parts by weight (2) Sodium silicate/water glass: 14 parts by weight The results of Table 2 indicate that Examples 1 to 5 according to the present invention are strong in magnetic coercive force, high in magnetic flux density as well as extremely excellent in heat resistance and corrosion resistance, as compared with a glass bond Nd—Fe—B of Example 1. Br in the Table denotes the residual magnetic flux density.

EXAMPLE 7

(A) Preparation of a Hydraulic-Composition Bonded Magnet

To the raw materials indicated below was added 20 parts by weight of water and mixed, and then the resulting material was press molded at an application pressure of 1.2 ton/cm$^2$ without a magnetic field using a press machine (product of Fujidempa Kogyo Co., Ltd., hot press machine High Multi 5000, mold 10ϕ). Thereafter, the material was matured in an autoclave under the conditions of 180° C. and an atmospheric pressure of 9.9. Then, the molded body was magnetized at 60 kOe to obtain an Nd—Fe—B based hydraulic-composition bonded magnet.

(1) Rare earth element-based hard magnetic powder: Nd—Fe—B based alloy powder subjected to oxidation resistance treatment (available from MQI Corp., MQP-B) 87 parts by weight (2) Hydraulic powder: Portland cement 6 parts by weight (3) Non-hydraulic powder: silica fumed 7 parts by weight (4) Processing modifier: vinyl acetate acryl copolymer resin 5 parts by weight (B) Measurements of Magnetic Properties and Density as Well as Evaluation of Heat Resistance The molded body was measure for the magnetic properties by means of a BH curve tracer (the same as above). For heat resistance properties, the molded body was subjected to the measurements of the change in appearance and the initial demagnetizing factor after it was maintained at 270° C. for 20 minutes.

The results produced for physical properties and magnetic properties of the bonded magnet are given in Table 3.

EXAMPLE 8

An Nd—Fe—B based hydraulic-composition bonded magnet was produced by means of an operation similar to the case in Example 7 with the exception that the maturing conditions were set at 190° C. at an atmospheric pressure of 9.9.

EXAMPLE 9

An Nd—Fe—B based hydraulic-composition bonded magnet was produced by means of an operation similar to the case in Example 7 with the exception that the maturing conditions were set at 200° C. at an atmospheric pressure of 9.9.

EXAMPLE 10

An Nd—Fe—B based hydraulic-composition bonded magnet was produced by means of an operation similar to the case in Example 7 with the exception that the maturing conditions were set at 210° C. at an atmospheric pressure of 9.9.

EXAMPLE 11

An Sm—Co based hydraulic-composition bonded magnet was produced by means of an operation similar to the case in Example 7 with the exception that an Sm—Co powder (product of Shin-Etsu Chemical Co., Ltd., 1–5 system, mean particle diameter 7 μm) was used in place of an Nd—Fe—B based alloy powder and that a magnetic field of 12 kOe was applied using an orientation magnetic field generating apparatus during press molding.

EXAMPLE 12

An Sm—Co based hydraulic-composition bonded magnet was produced by means of an operation similar to the case in Example 11 with the exception that the maturing conditions were set at 200° C. at an atmospheric pressure of 9.9.

EXAMPLE 13

An Sm—Co based hydraulic-composition bonded magnet was produced by means of an operation similar to the case in Example 11 with the exception that the maturing conditions were set at 220° C. at an atmospheric pressure of 9.9.

EXAMPLE 14

An Sm—Co based hydraulic-composition bonded magnet was produced by means of an operation similar to the case in Example 11 with the exception that the maturing conditions were set at 240° C. at an atmospheric pressure of 9.9.

EXAMPLE 15

An Sm—Fe—N based hydraulic-composition bonded magnet was produced by means of an operation similar to the case in Example 7 with the exception that an Sm—Fe—N based magnetic powder (product of Nichia Corporation, RTN, Z12 mean particle diameter 2.3 $\mu$m) was used in place of an Nd—Fe—B based alloy powder and that a magnetic field of 12 KOe was applied by means of an orientation magnetic field generating apparatus during press molding.

EXAMPLE 16

An Sm—Fe—N based hydraulic-composition bonded magnet was produced by means of an operation similar to the case in Example 15 with the exception that the maturing conditions were set at 190° C. at an atmospheric pressure of 9.9.

EXAMPLE 17

An Sm—Fe—N based hydraulic-composition bonded magnet was produced by means of an operation similar to the case in Example 15 with the exception that the maturing conditions were set at 200° C. at an atmospheric pressure of 9.9.

EXAMPLE 18

An Sm—Fe—N based hydraulic-composition bonded magnet was produced by means of an operation similar to the case in Example 15 with the exception that the maturing conditions were set at 210° C. at an atmospheric pressure of 9.9.

EXAMPLE 19

An Sm—Fe—N based hydraulic-composition bonded magnet was produced by means of an operation similar to the case in Example 15 with the exception that the face pressure was set at 0.6 ton/cm$^2$ during molding.

EXAMPLE 20

An Sm—Fe—N based hydraulic-composition bonded magnet was produced by means of an operation similar to the case in Example 15 with the exception that the face pressure was set at 0.8 ton/cm$^2$ during molding.

EXAMPLE 21

An Sm—Fe—N based hydraulic-composition bonded magnet was produced by means of an operation similar to the case in Example 19 with the exception that the maturing conditions were set at 210° C. at an atmospheric pressure of 9.9.

Table 3 shows that, for the properties of a hydraulic-composition bonded magnet, the higher the maturing temperature, the higher the density of a molded body tends to be, on the other hand, the magnetic coercive force tends to decrease as the magnetic powder deteriorates due to oxidation.

In addition, molded bodies of a high porosity were confirmed to exhibit breaks (explosion) after the heat resistance test. This seems to be because gas in closed pores thermally expanded in addition to the decrease of the strength of bonded magnets associated with the increase of the porosity. In particular, Example 19 in which the porosity exceeded 20% shows that the occurrence of the break dramatically lowers the yield. Additionally, even in molded bodies that do not have a break, the strength is very low and thus fallout of the magnetic powers and hydraulic composition particles is likely to occur, which sometimes produces a problem at the time of use. Therefore, the porosity is preferably 20% or less.

Moreover, it is shown that the higher the magnetic coercive force, the less the decrease of the initial demagnetizing factor, and that when the magnetic coercive force is less than 7 kOe, the initial demagnetizing factor is sharply lowered. Thus, in order to obtain stable magnetic properties, the magnetic coercive force is preferably 7 kOe or more.

TABLE 3

| | Density of molded body [g/cm$^3$] | Theoretical density [g/cm$^3$] | Porosity [%] | Magnetic properties: Bhmax [MGOe] | Magnetic properties: Magnetic coercive force [kO] | Magnetic properties: Yield [%] | Initial demagnetizing factor (270° C., 20 min.) [%] |
|---|---|---|---|---|---|---|---|
| Example 7 | 5.8 | 6.2 | 6.5 | 4.2 | 8.3 | 100 | 18.6 |
| Example 8 | 5.9 | 6.2 | 4.8 | 4.1 | 7.7 | 100 | 23.6 |
| Example 9 | 6.0 | 6.2 | 3.2 | 4.1 | 7.2 | 100 | 25.4 |
| Example 10 | 6.1 | 6.2 | 1.6 | 4.0 | 6.4 | 100 | 68.8 |
| Example 11 | 6.3 | 6.6 | 4.5 | 5.3 | 8.7 | 100 | 17.5 |
| Example 12 | 6.4 | 6.6 | 3.0 | 5.2 | 8.2 | 100 | 17.3 |
| Example 13 | 6.5 | 6.6 | 1.5 | 5.1 | 7.1 | 100 | 25.6 |
| Example 14 | 6.6 | 6.6 | 0.0 | 5.0 | 6.6 | 100 | 57.3 |
| Example 15 | 5.8 | 6.2 | 6.5 | 5.8 | 12.4 | 100 | 13.2 |
| Example 16 | 5.9 | 6.2 | 4.8 | 5.7 | 10.5 | 100 | 15.3 |
| Example 17 | 6.0 | 6.2 | 3.2 | 5.6 | 8.1 | 100 | 20.3 |
| Example 18 | 6.1 | 6.2 | 1.6 | 5.5 | 6.7 | 100 | 73.2 |
| Example 19 | 4.7 | 6.2 | 24.2 | 3.5 | 9.1 | 60 | 15.3 |

TABLE 3-continued

| | Density of molded body [g/cm³] | Theoretical density [g/cm³] | Porosity [%] | Magnetic properties Bhmax [MGOe] | Magnetic coercive force [kO] | Yield [%] | Initial demagnetizing factor (270° C., 20 min.) [%] |
|---|---|---|---|---|---|---|---|
| Example 20 | 5.5 | 6.2 | 11.3 | 3.8 | 8.5 | 95 | 17.2 |
| Example 21 | 5.0 | 6.2 | 19.4 | 3.6 | 6.5 | 90 | 68.0 |

EXAMPLE 22

(A) Preparation of a Hydraulic-composition Bonded Magnet

To the raw materials indicated below was added 20 parts by weight of water and mixed, and then the resulting material was press molded at an application pressure of 1.2 ton/cm$^2$ without a magnetic field using a press machine (product of Fujidempa Kogyo Co., Ltd., hot press machine High Multi 5000, mold 10ϕ). Thereafter, the material was matured in an autoclave under the conditions of 180° C. and an atmospheric pressure of 9.9. Then, the molded body was magnetized at 60 kOe to obtain an Nd—Fe—B based hydraulic-composition bonded magnet.

(1) Rare earth element-based hard magnetic powder: Nd—Fe—B based alloy powder subjected to oxidation resistance treatment (available from MQI Corp., MQP-O) 87 parts by weight (2) Hydraulic powder: Portland cement 6 parts by weight (3) Non-hydraulic powder: silica fumed 7 parts by weight (4) Processing modifier: vinyl acetate acryl copolymer resin 5 parts by weight (B) Measurements of Magnetic Properties and Density as Well as Evaluation of Heat Resistance The molded body was measure for the magnetic properties by means of a BH curve tracer (the same as above). For heat resistance properties, the molded body was subjected to the measurements of the change in appearance (degree of change in diameter) and the initial demagnetizing factor after it was maintained at 210° C. for 20 minutes and after its temperature was raised by 20° C. to 270° C. The results produced for physical properties and magnetic properties of the bonded magnet are given in Table 4. In addition, similar measurements were carried out on the Examples and Comparative. Examples below.

EXAMPLE 23

An Nd—Fe—B based hydraulic-composition bonded magnet was produced by means of an operation similar to the case in Example 22 with the exception that the mold shape was set to be ϕ45.

EXAMPLE 24

An Sm—Co based hydraulic-composition bonded magnet was produced by means of an operation similar to the case in Example 22 with the exception that an S—Co powder (product of Shin-Etsu Chemical Co., Ltd., 2–17 system, mean particle diameter 7 μm) was used in place of an Nd—Fe—B based alloy powder and that a magnetic field of 12 kOe was applied using an orientation magnetic field generating apparatus during press molding.

EXAMPLE 25

An Sm—Fe—N based hydraulic-composition bonded magnet was produced by means of an operation similar to the case in Example 22 with the exception that an Sm—Fe—N based magnetic powder (product of Nichia Corporation, RTN, Z12 mean particle diameter 2.3 μm) was used in place of an Nd—Fe—B based alloy powder and that a magnetic field of 12 kOe was applied by means of an orientation magnetic field generating apparatus during press molding.

COMPARATIVE EXAMPLE 2

A composition for a rare earth element-based bonded magnet (hereinafter, referred as a compound) was produced by subjecting the mixture below to sufficient kneading (kneading temperature 260° C.) using a two-axis extrusion kneader, followed by extrusion, cooling and cutting. Thereafter, the compound was warm press molded at 260° C. at an application pressure of 8 ton/cm$^2$ without a magnetic field by means of a press machine (the same as above, mold 10ϕ) and then the resulting molded body was magnetized at 60 kOe and compression molded to produce an Nd—Fe—B based hydraulic-composition bonded magnet.

(1) Rare earth element-based hard magnetic powder: Nd—Fe—B based alloy powder (product of MQI Corp., MQP-O) 97 parts by weight (2) Bonding resin: polyamide resin (nylon 6) 3 parts by weight

COMPARATIVE EXAMPLE 3

An Nd—Fe—B based hydraulic-composition bonded magnet was produced in accordance with Comparative Example 2 except that polybutylene terephthalate (PBT) was used in place of nylon 6.

COMPARATIVE EXAMPLE 4

A thermosetting resin (epoxy resin) was used instead of nylon 6 in Comparative Example 2 and further the compound was press molded at an application pressure of 8 ton/cm$^2$ without a magnetic field by means of a press machine (the same as above, mold 10ϕ) and then the produced molded body was cured by heat treatment for two hours at 150° C. and thereafter the resulting molded body was magnetized at 60 kOe to produce an Nd—Fe—B based hydraulic-composition bonded magnet.

COMPARATIVE EXAMPLE 5

A composition was produced by subjecting the mixture below to sufficient kneading (kneading temperature 300° C.) using a two-axis extrusion kneader, followed by extrusion, cooling and cutting. Thereafter, the compound was injection molded at 300° C. without a magnetic field by means of an injection molding machine (a mold 10ϕ×6 t) and then the resulting molded body was magnetized at 60 kOe to produce an Nd—Fe—B based hydraulic-composition bonded magnet.

(1) Rare earth element-based hard magnetic powder: Nd—Fe—B based alloy powder (product of MQI Corp., MQP-O) 87 parts by weight (2) Bonding resin: PPS 12 parts by weight (3) Antioxidant: triethylene glycol 0.6 part by weight (4) Lubricant: paraffin wax 0.4 part by weight

TABLE 4

| | Properties of molded body | | Heat resistance properties | | | | | | | |
|---|---|---|---|---|---|---|---|---|---|---|
| | Density of | Magnetic property | Degree of deformation (diameter direction) [%] | | | | Initial demagnetizing factor [%] | | | |
| | molded body [g/cm³] | GHmax [MGOe] | 210 [° C.] | 230 [° C.] | 250 [° C.] | 270 [° C.] | 210 [° C.] | 230 [° C.] | 250 [° C.] | 270 [° C.] |
| Example 22 | 5.9 | 8.0 | 0 | 0 | 0 | 0 | 4.1 | 7.0 | 12.0 | 17.3 |
| Example 23 | 5.9 | 8.0 | 0 | 0 | 0 | 0 | 4.0 | 7.2 | 12.1 | 17.3 |
| Example 24 | 5.2 | 11.8 | 0 | 0 | 0 | 0 | 5.0 | 10.3 | 14.1 | 19.1 |
| Example 25 | 4.7 | 13.0 | 0 | 0 | 0 | 0 | 3.2 | 6.5 | 10.4 | 16.0 |
| Comparative Example 2 | 5.9 | 9.1 | +2 | +5 | +15 | X | 10.6 | 20.3 | 35.7 | X |
| Comparative Example 3 | 5.9 | 9.1 | +2 | +5 | +15 | X | 10.8 | 21.4 | 40.1 | X |
| Comparative Example 4 | 5.9 | 9.1 | 0 | +3 | +10 | X | 9.5 | 18.6 | 33.1 | X |
| Comparative Example 5 | 4.8 | 5.2 | 0 | 0 | 0 | 0 | 8.1 | 16.5 | 30.8 | 43.2 |

The symbol X indicates that the amount of deformation is too large and thus the measurement is impossible.

As shown in Table 4, hydraulic-composition bonded magnets of the present invention sufficiently maintain the shape thereof even after the heat resistance testing, and did not exhibit any changes in appearance. In addition, they exhibited low initial demagnetizing factors, indicating that the deterioration of the magnetic properties is not marked.

On the other hand, the magnets of the Comparative Examples using nylon 6, PBT and an epoxy resin can not hold the shape thereof after heat resistance testing, showing a large degree of deformation. Additionally, the results of the initial demagnetizing factor show that the magnetic properties of the bonded magnets of all the Comparative Examples, including the magnet using PPS, are greatly deteriorated.

As discussed thus far, according to a hydraulic-composition bonded magnet of the present invention, a hydraulic composition having the particles of a rare earth element-based hard magnetic powder bonded to each other passivates the particles of the rare earth element-based hard magnetic powder during maturing and curing, thereby producing the effects of the magnet being excellent in heat resistance and corrosion resistance as well as high in magnetic coercive force and magnetic flux density as compared with conventionally proposed glass bonded magnets.

TABLE 2

| | Example 1 | Example 2 | Example 3 | Example 4 | Example 5 | Example 6 | Comparative Example 1 |
|---|---|---|---|---|---|---|---|
| Rare earth element based hard magnetic powder | Nd • Fe • B isotropic raw material | Sm • Fe • N anisotropic raw material | Sm • Co anisotropic raw material | Nd • Fe • B anisotropic raw material | Nd • Fe • B isotropic raw material | Nd • Fe • B isotropic raw material | Nd • Fe • B isotropic raw material |
| iHc of raw material powder (kOe) | 9.7 | 12.1 | 9.0 | 10.0 | 9.7 | 9.7 | 9.7 |
| Press pressure (ton/cm²) | 1.2 | 1.2 | 1.2 | 1.2 | Extrusion | 1.2 | 1.2 |
| External magnetic field (12 kOe) | Nil | 12 kOe | 12 kOe | 12 kOe | Nil | Nil | Nil |
| Density of molded body (g/cm³) | 5.9 | 4.7 | 5.2 | 6.0 | 5.9 | 5.9 | 5.9 |
| Magnetic properties | | | | | | | |
| Br (kG) | 5.6 | 7.6 | 7.0 | 7.8 | 5.6 | 5.6 | 5.0 |
| IHc (kOe) | 8.2 | 9.7 | 8.5 | 10.0 | 8.2 | 14.5 | 5.0 |
| BH (max) (M · G · Oe) | 8.0 | 13.0 | 11.8 | 14.0 | 8.0 | 8.8 | 4.3 |
| Irreversible demagnetizing factor (150° C.) | | | | | | 2.1% | |
| Heat resistance HDT (18.6 kg/cm³) | 280° C. or higher | 280° C. or higher | 280° C. or higher | 280° C. or higher | 280° C. or higher | 280° C. or higher | 180° C. |

TABLE 2-continued

| | Example 1 | Example 2 | Example 3 | Example 4 | Example 5 | Example 6 | Comparative Example 1 |
|---|---|---|---|---|---|---|---|
| 5% salt spray after 180 days | ◎ | ◎ | ◎ | ◎ | ◎ | ◎ | X |

What is claimed is:

1. A hydraulic-composition bonded magnet, wherein a magnetic powder is held in a hydraulic composition produced by cure of a hydraulic powder together with at least one of a non-hydraulic powder and a processing modifier, and the magnetic coercive force (iHc) is 7 kOe or more, and the porosity is 20% or less.

2. A hydraulic-composition bonded magnet wherein a magnetic powder is held in a hydraulic composition produced by cure of a hydraulic powder together with at least one of a non-hydraulic powder and a processing modifier, and the magnet is prepared by adding 1 to 10 parts by weight of colloidal silica to 100 parts by weight of said hydraulic composition and then maturing at 120° C. or higher.

3. A hydraulic-composition bonded magnet produced by impregnating colloidal silica into a hydraulic-composition bonded magnet and subsequently maturing at 100° C. or higher, wherein a magnetic powder is held in a hydraulic composition produced by cure of a hydraulic powder together with at least one of a non-hydraulic powder and a processing modifier.

* * * * *

UNITED STATES PATENT AND TRADEMARK OFFICE

CERTIFICATE OF CORRECTION

PATENT NO. : 6,890,381 B2
DATED : May 10, 2005
INVENTOR(S) : Satoshi Ozawa et al.

It is certified that error appears in the above-identified patent and that said Letters Patent is hereby corrected as shown below:

Title page,
Insert Item:
-- [30] Foreign Application Priority Data
April 28, 2000 (JP)……..2000-130031 --.

Signed and Sealed this

Sixteenth Day of August, 2005

JON W. DUDAS
*Director of the United States Patent and Trademark Office*